United States Patent [19]

Li et al.

[11] Patent Number: 4,950,337

[45] Date of Patent: Aug. 21, 1990

[54] MAGNETIC AND MECHANICAL PROPERTIES OF AMORPHOUS ALLOYS BY PULSE HIGH CURRENT

[75] Inventors: James C. Li, 39 Crestview Dr., Pittsford, N.Y. 14534; Huang Der-Ray, Rochester, N.Y.

[73] Assignees: China Steel Corporation, Kaohsiung, Taiwan; James C. Li, Pittsford, N.Y.

[21] Appl. No.: 338,895

[22] Filed: Apr. 14, 1989

[51] Int. Cl.[5] ..... C22C 45/00

[52] U.S. Cl. ..... 148/121; 148/120

[58] Field of Search ..... 148/121, 120, 122

[56] References Cited

U.S. PATENT DOCUMENTS 4,726,855 2/1988 Tsutsui et al. ..... 148/108

FOREIGN PATENT DOCUMENTS 59-151403 8/1984 Japan ..... 148/121

61-147816 7/1986 Japan ..... 148/121

*Primary Examiner*—John P. Sheehan

*Attorney, Agent, or Firm*—Cushman, Darby & Cushman

[57] ABSTRACT

A heating process of improving the magnetic and mechanical properties of ferromagnetic amorphous alloys wherein the amorphous ribbon is treated with rapid heating and rapid magnetic domain impacting in a direct heating manner by means of pulsed high current to improve the magnetism of ferromagnetic amorphous alloys with reduced or eliminated the annealing embrittlement thereof.

The heating process is performed in the following conditions:

pulse current density: $J \geqq 10^3$ A/cm$^2$ pulse duration: tp = 1 ns–100 ms frequency: f = 1 Hz–1,000 Hz heating time: tn = 1 sec.–100 secs.

4 Claims, 8 Drawing Sheets

MAGNETIC AND MECHANICAL PROPERTIES OF AMORPHOUS ALLOYS BY PULSE HIGH CURRENT

BACKGROUND OF THE INVENTION

The iron base and nickel base amorphous alloys produced via rapid quenching technique possess good mechanical properties. However, to acquire desirable soft magnetic properties (low magnetic energy loss, low magnetic coercivity, and high magnetic permeability, etc.), a long period of magnetic field annealing process (1-2 hours) in the furnace is required. Consequently, the annealing embrittlement occurs inevitably to create many difficulties in practice.

The successfully tested pulsed high current method of the present invention applies direct rapid heating and rapid magnetic domain impacting of the ferromagnetic amorphous alloys to improve the magnetic domain effect therein and eliminate the structure relaxation due to long periods of heating. It is proved that magnetic properties of ferromagnetic amorphous alloys are improved and the annealing embrittlement is nearly eliminated.

The invention will be now described in detail through the following description with reference to the accompanying drawings wherein:

BRIEF DESCRIPTION OF THE DRAWINGS

FIG. 2 shows the temperature test on a specimen during the heating process;

FIG. 8-1 shows the hysteresis loop of a straight specimen 2605S2 in an applied magnetic field (−1 Oe-1 Oe) before and after heat treatment;

FIG. 8-2 shows the hysteresis loop of a straight specimen 2605S2 in an applied magnetic field (−2 Oe-2 Oe) before and after heat treatment;

FIG. 9-1 shows the hysteresis loop of a straight specimen 2826MB in an applied magnetic field (−0.5 Oe-0.5 Oe) before and after heat treatment;

FIG. 9-2 shows the hysteresis loop of a straight specimen 2826MB in an applied magnetic field (−1 Oe-1 Oe) before and after heat treatment; and FIG. 9-3 shows the hysteresis loop of a straight specimen 2826MB in an applied magnetic field (−2 OE-2 OE) before and after heat treatment.

DETAILED DESCRIPTION OF THE PREFERRED EMBODIMENT

Figure 1:
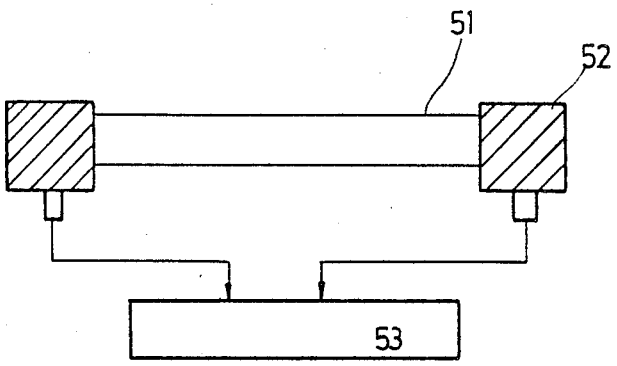
FIG. 1-1 and 1-2 show the procedure of processing the straight and toroidal specimens by means of pulsed high currents.
Figures 1, 2:
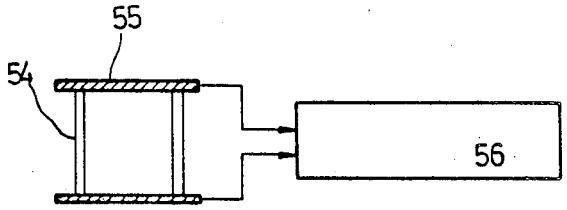
Figure 2:
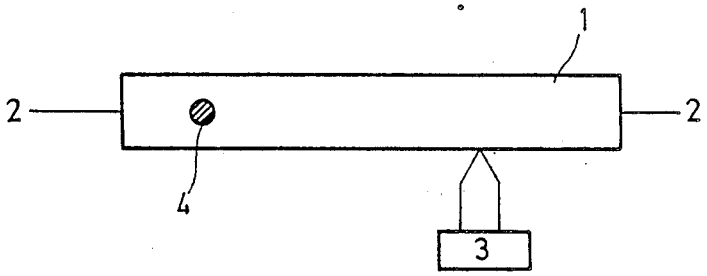

Refer to FIGS. 1-1 and 1-2 showing the procedure of processing the straight and toroidal specimens with pulsed high current is shown in FIGS. 1-1 and 1-2.

The pulsed high current method is a heat treating process which produces fast direct heating, wherein the temperature goes up and goes down so quickly under the instantaneous high current Joule effect that the specimen will not be crystallized but remains amorphous.

The straight specimen or toroidal specimen can be alternatively adopted in pulsed high current method according to application requirements. The straight specimen 51 is formed by a long thin amorphous alloy strip, the two ends of which are respectively clamped by two square copper plates 52 acting as two electrodes connected to the pulse generator 53. While the toroidal specimen 54 is made by means of winding an amorphous ribbon with uniform width into a toroid, and then parallel clamped two sides thereof with two square copper plates 55 connected to the pulse generator 56.

The pulse generator used in the pulsed high current method outputs a high current, but a low voltage, the frequency range of which is as follows:

frequency; f=1 Hz-1,000 Hz pulse current density: $J \geqq 10$ A/cm$^2$ pulse duration: tp=1 ns-100 ms Now referring to FIG. 2, the temperature test during heating process on specimen 1 is shown. The specimen 1 is clamped by the tips of a hair thin thermocouple 3, the other portion of which is covered by a mica plate for insulation from the specimen 1. The heating temperature curve can be recorded from the voltage between two ends of the thermocouple 3. This temperature curve can be calibrated with OMEGALAQ (200° C.-1,000° C.) as a reference for temperature determination.

Figure 3:
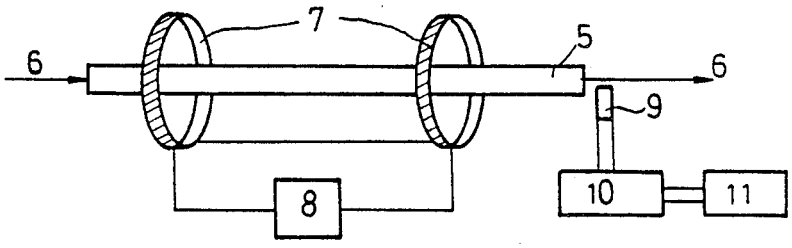
FIG. 3 shows the magnetic test on a specimen during the heating process.
Figure 4:
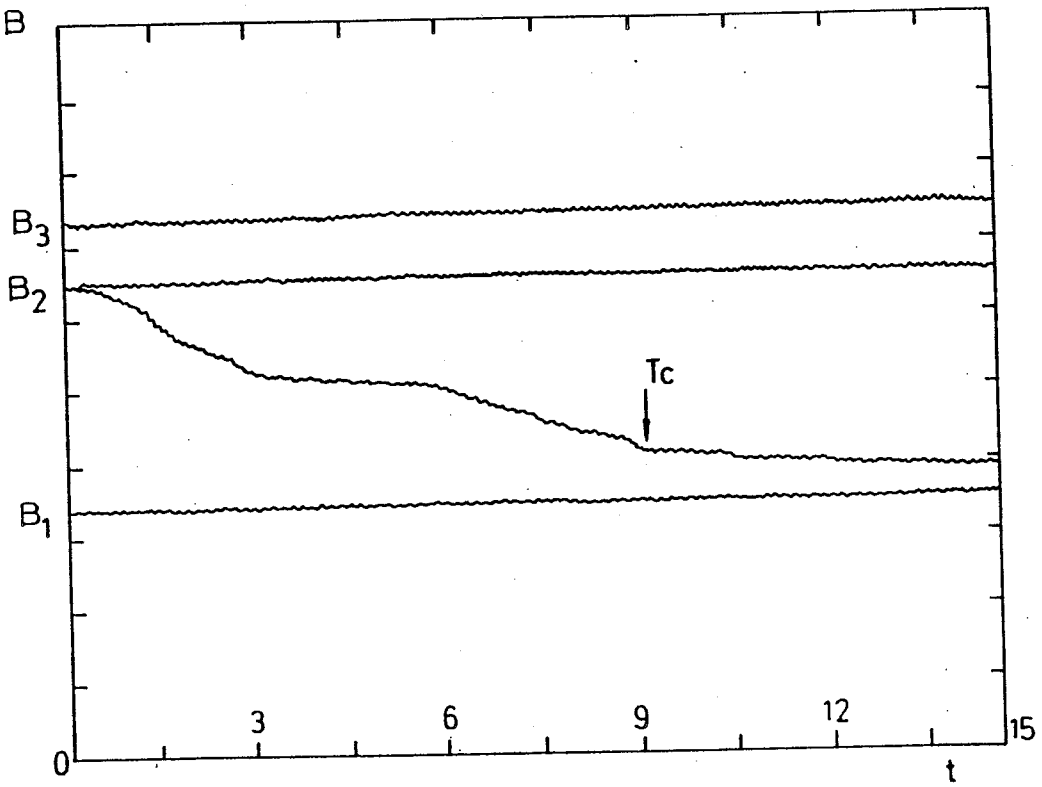
FIG. 4 shows the functions curve of magnetic induction with respect to temperature during a specimen 2826MB heating period of 15 seconds.

Now referring to FIG. 3, the magnetism test during heating process on specimen 5 is shown. The specimen 5 is placed in a uniform magnetic field and heated by pulsed current 6. The magnetic field is produced by a solenoid coil or a set of Helmholtz coils 7 connected to a DC power supply 8. A Hall probe 9 is placed near one end of the specimen 5. The probe 9 is connected to a Gauss meter 10 which is connected to a data acquisition device 11 for measuring the magnetic induction of the specimen 5. The magnetic induction decreases when temperature increases, and it abruptly goes down when the temperature goes over a critical point (the ferromagnetism-paramagnetism transition temperature). An optimal operating point can be thus chosen according to the characteristic curve of magnetic induction vs. temperature. Now referring to FIG. 4 showing the function curve of magnetic induction with respect to heating time during a specimen 2826MB heating period of 15 seconds. A comparison between magnetic induction values of the specimen before and after heat treatment is also shown in FIG. 4 wherein:

t: heating time (sec.)

B: magnetic induction $B_1$: reference magnetic field $B_2$: magnetic induction of specimen before heating $B_3$: magnetic induction of specimen after heating Tc: Curie temperature As shown in FIG. 4, the optimal operating point can be selected above the dynamic curie temperature and below the dynamic crystallization point.

Figure 5:
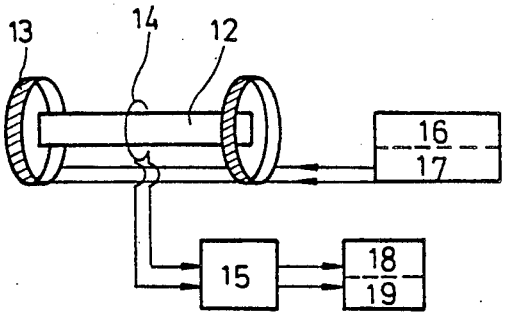
FIG. 5 shows a magnetic test on a straight specimen.

A magnetic test on a straight specimen 12 after heat treatment is shown in FIG. 5. The straight specimen 12 is placed in a uniform magnetic field created by a pair of Helmholtz coils 13. The specimen 12 is surrounded by a search coil 14, which connects with a fluxmeter or an integrator 15 to measure the value of magnetic induction B(G). The control of sign and magnitude of the uniform applied magnetic field H (Oe) can be made by means of a DC bipolar power supply 16 or function generator 17. Furthermore, the DC B-H hysteresis loop of specimen 12 can be acquired by means of plotting the output signal from DC bipolar power supply 16 or function generator 17 (applied magnetic field H) against the search coil 14 signal (magnetic induction B) using the X-Y recorder 18. The AC B-H hysteresis loop can be measured via connection to an oscilloscope 19.

Figure 6:
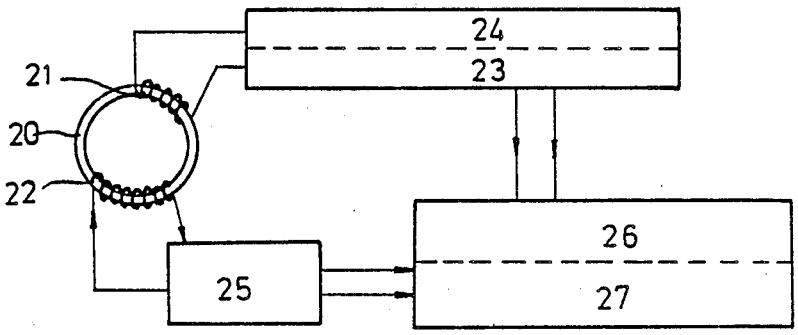
FIG. 6 shows a magnetic test on a toroidal specimen.

A magnetic test on a toroidal specimen 20 after heat treating is shown in FIG. 6. A primary coil 21 and secondary coil 22 are formed by means of winding enamel wires around the toroidal specimen 20. The primary coil 21 is connected to a DC bipolar power supply 23 or a function generator such as 17 in FIG. 5, and the secondary coil 22 is connected to a fluxmeter or integrator 25, and thereafter, both of them are connected to X-Y recorder 26 or oscilloscope 27 to measure the DC or AC B-H hysteresis loop.

Figure 7:
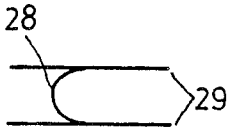
FIG. 7 shows a bending test on a specimen after heat treatment.

A bending test on specimen 28 after heat treating is shown in FIG. 7. This test can determine the annealing embrittlement degree of the amorphous alloy after heat treatment. The method of the test is to place the bent specimen 28 between two parallel metal plates 29, and gradually bringing these two metal plates 29 closer to together until the specimen 28 cracks, measuring the distance between metal plates 29 to determine the value, wherein:

the fracture strain $\epsilon f = d/D - d$ d = thickness of specimen 28

D = the distance between two metal plates 29 when specimen 28 cracks.

Figures 1, 8:
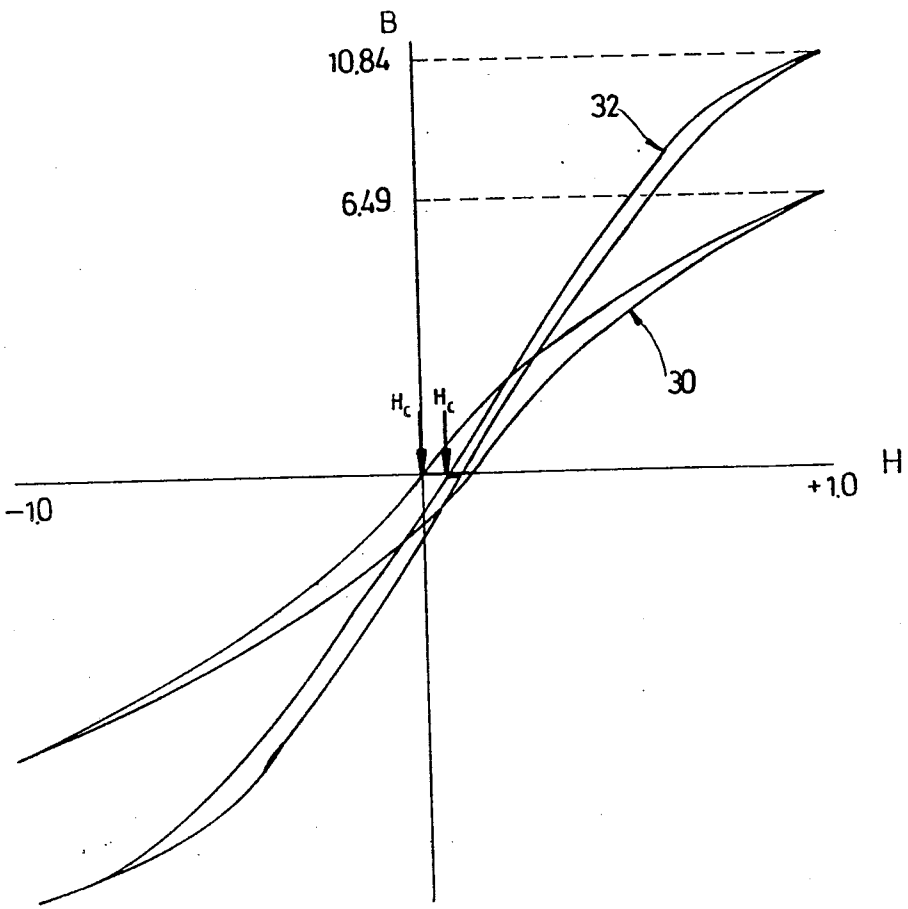
Figures 2, 8:
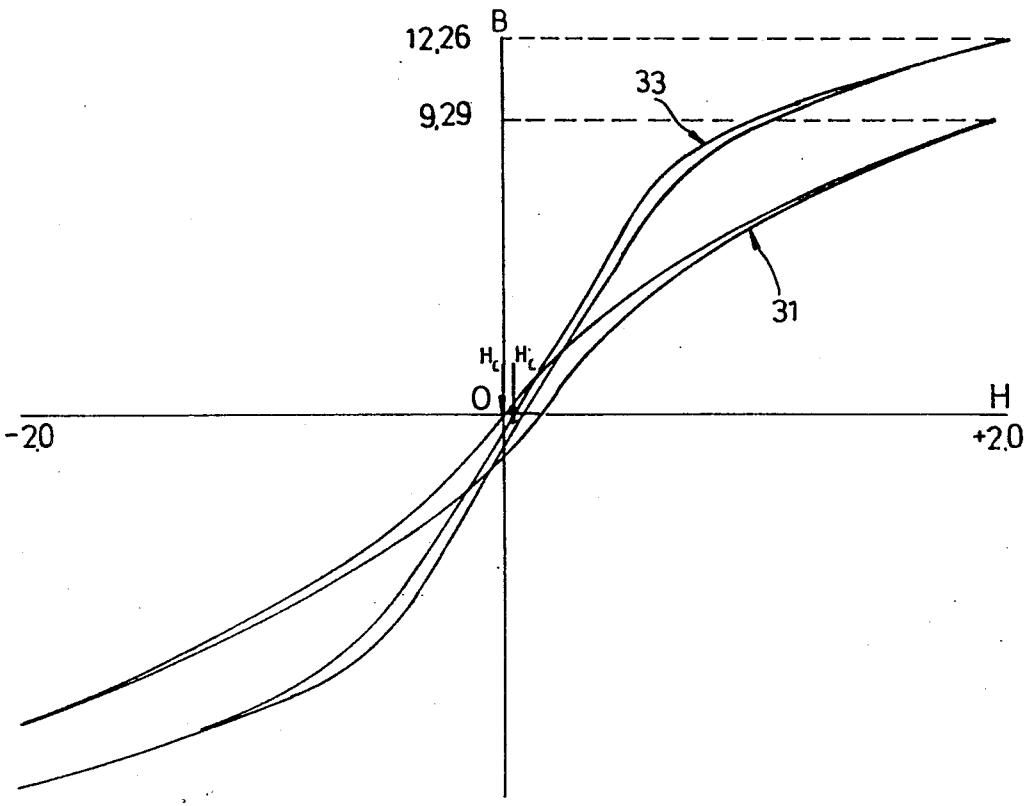
Figures 1, 9:
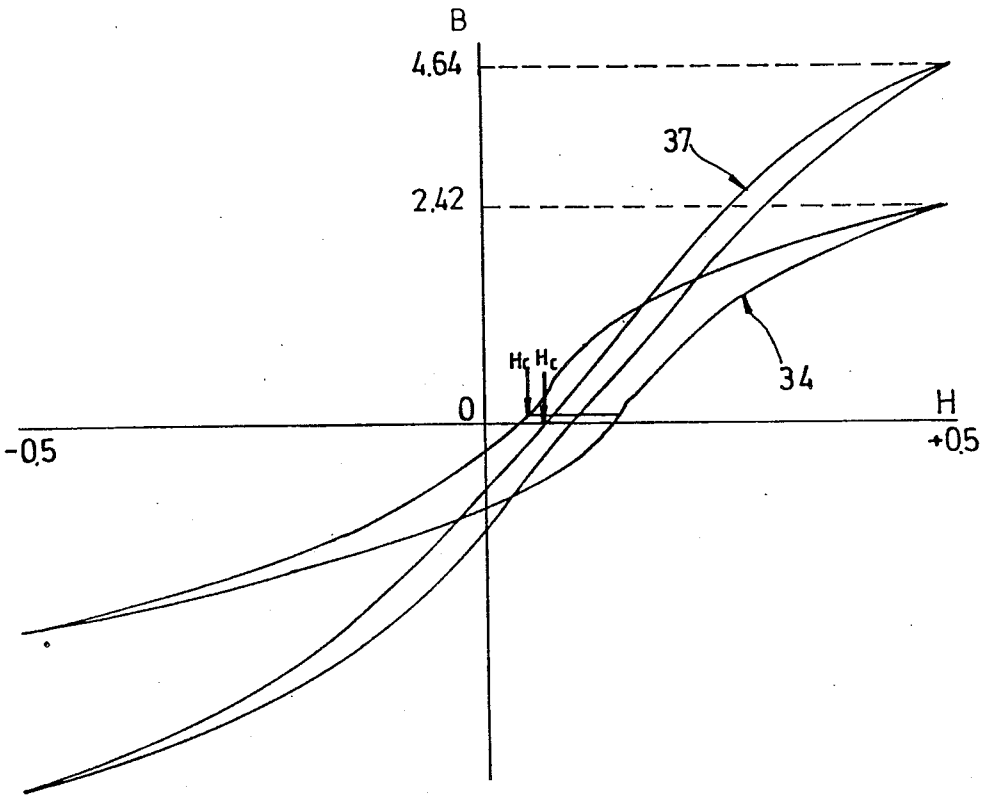
Figures 2, 9:
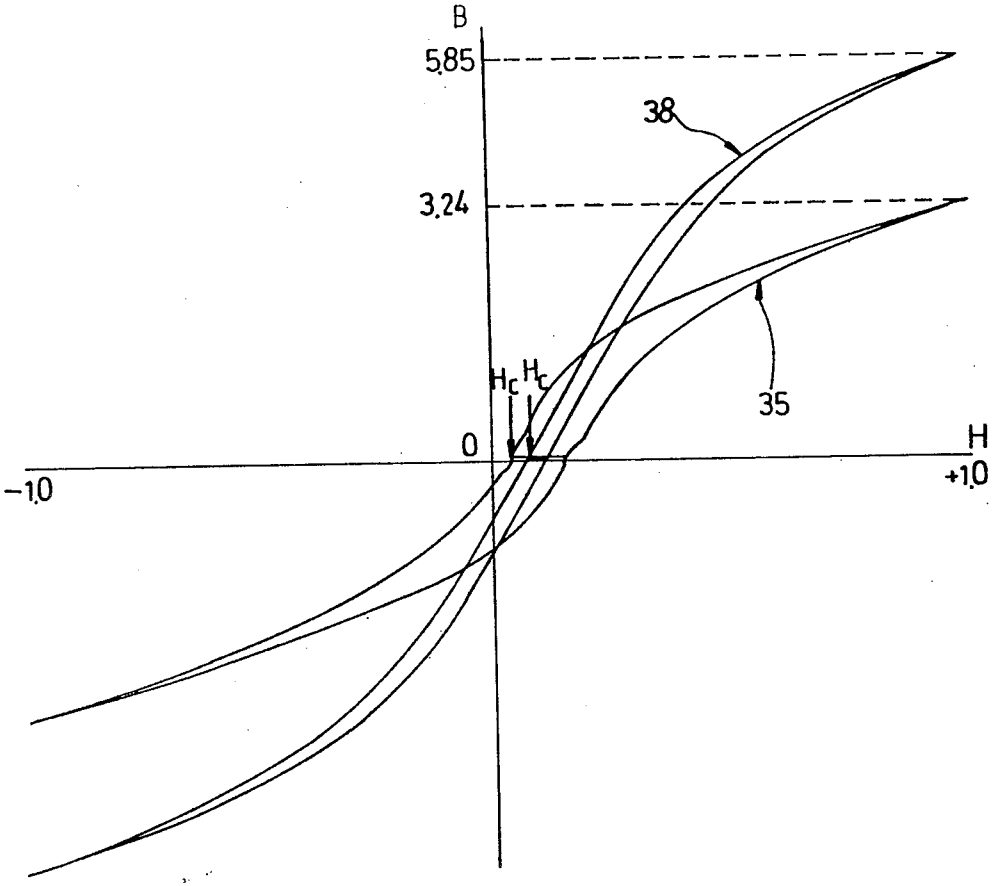
Figures 3, 9:
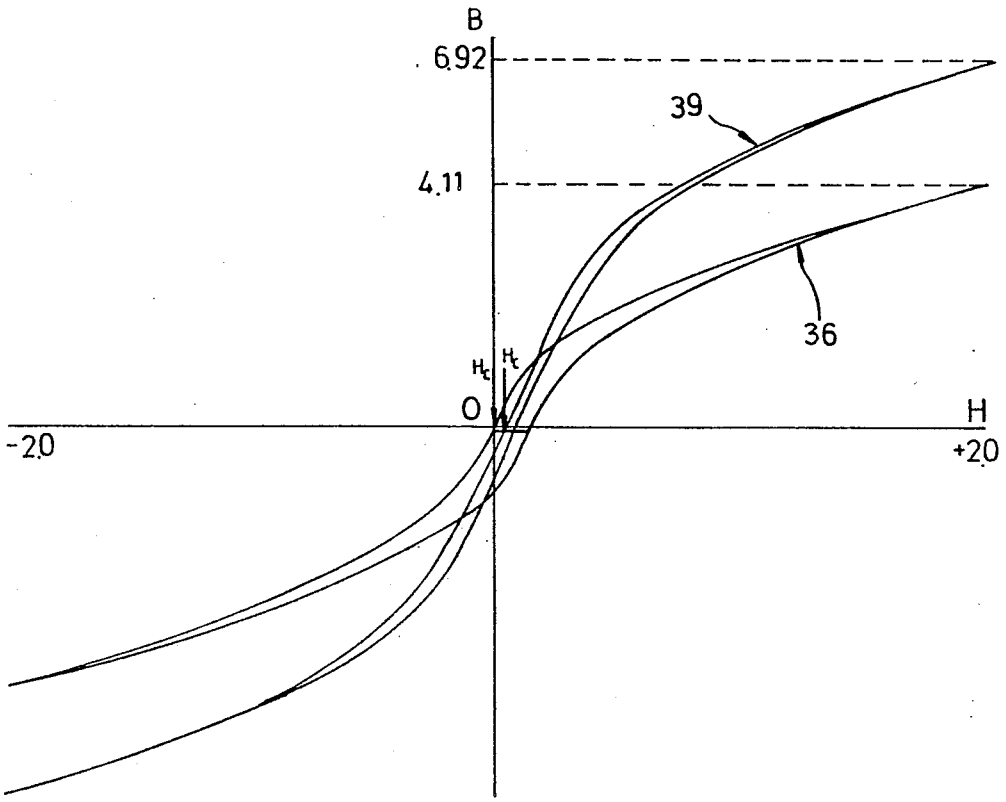

FIG. 8-1 and 8-2 show the hysteresis loops (open magnetic circuit measurement in an applied magnetic field −1 Oe to 1 Oe and −2 Oe to 2 Oe) of the specimen before and after heat treatment, wherein:

H: applied magnetic field (Oe)

B: magnetic induction (KG)

The straight specimen $Fe_{78}B_{13}Si_9$ (Allied 2605S2) is used, wherein:

length: 7.5 cm width: 7 mm thickness: 25 μm

The conditions required in the heat treating process using pulsed high current are as follows:

pulse current density: $J = 8.1 \times 10^4 A/cm^2$ frequency: f = 9.4 Hz pulse duration: tp = 271 μs heating time: tn = 20 secs.

Comparing the hysteresis loops 30, 31 (before heating) with those 32, 33 (after heating) which were measured within an applied magnetic field range −2 Oe to 2 Oe, the soft magnetic properties can be seen to have significantly improved as follows:

| | | before | after |
|---|---|---|---|
| (1) magnetic coercivity | Hc(Oe) | 0.064 | 0.02 |
| (2) magnetic induction | Bm(KG) | | |
| (when the applied magnetic field is 1 Oe) | | 6.49 | 10.84 |
| (when the applied magnetic field is 2 Oe) | | 9.29 | 12.26 |

Also, the annealed embrittlement of the specimen can be compared as follows:

| | Conventional annealing method | the present method |
|---|---|---|
| fracture strain (εf) | $7 \times 10^{-3}$–$5 \times 10^{-2}$ | 0.9–1 |

Please refer to FIGS. 9-1, 9-2, and 9-3 wherein the hysteresis loops (open magnetic circuit measurement) of another in applied magnetic field (−0.5 Oe–0.5 Oe, −1 Oe–1 Oe, and −2 Oe–2 Oe) of a second specimen before and after heat treatment, wherein:

H: applied magnetic field (Oe)

B: magnetic induction (KG)

The straight specimen $Fe_{40}Ni_{38}Mo_4B_{18}$ (Allied 2826MB) is used, wherein:

length: 7.5 cm width: 7 mm thickness: 32 μm

The conditions required in the heating process using pulsed high current are as follows:

pulse current density: $J = 6.58 \times 10^8 A/cm^2$ frequency: f = 9.4 hz pulse duration: tp = 271 μs heating time: tn = 20 secs.

Comparing the hysteresis loops 34, 35, 36 (before heating) with those 37, 38, 39 (after heating) which were measured within applied magnetic field range −2 Oe to 2 Oe, the soft magnetic properties are significantly improved as follows:

| | | before | after |
|---|---|---|---|
| (1) magnetic coercivity | Hc(Oe) | 0.045 | 0.0075 |
| (2) magnetic induction | Bm(KG) | | |
| (when the applied magnetic field is 0.5 Oe) | | 2.42 | 4.64 |
| (when the applied magnetic field is 1 Oe) | | 3.24 | 5.85 |
| (when the applied magnetic field is 2 Oe) | | 4.11 | 6.92 |

The annealed embrittlement of specimen can be compared as follows:

| | Conventional annealing method | the present method |
|---|---|---|
| fracture strain (εf) | $9 \times 10^{-3}$–$5 \times 10^{-2}$ | 0.9–1 |

What is claimed is:

1. A method of improving the magnetic and mechanical properties of ferromagnetic amorphous alloys without causing annealing embrittlement, said method comprising the step of applying a pulsed high current to a ferromagnetic amorphous ribbon so as to rapidly heat the ribbon by the Joule effect, thereby relieving quenched-in stress of the amorphous ribbon.

2. The method of claim 1, wherein the step of applying a pulsed current includes the step of applying a dc pulsed current having a pulse current density of at least $10^3 A/cm^2$, a frequency in a range of 1–1000 Hz, a pulse duration in a range of 1 ns–100 msec and a heating time in a range of 1 sec–100 sec.

3. A method as claimed in claim 1, wherein the ferromagnetic amorphous ribbon is one of a straight specimen and a toroidal specimen.

4. A method as in claim 1, wherein the ferromagnetic amorphous alloys are made of metals selected from the group consisting of Allied 2605S2 ($Fe_{78}B_{13}Si_9$), Allied 2605SC ($Fe_{81}B_{13.5}Si_{3.5}C_2$), Allied 2826MB ($Fe_{40}Ni_{38}Mo_4B_{18}$), and Allied 2705MN ($Co_{70}Fe_2Mn_4B_{12}Si_6$).

* * * * *